US005843583A

United States Patent [19]

D'Haene et al.

[11] Patent Number: 5,843,583

[45] Date of Patent: Dec. 1, 1998

[54] CORD WITH HIGH NON-STRUCTURAL ELONGATION

[75] Inventors: Urbain D'Haene, Ingooigem; Marc Eggermont, Aalter; Dirk Meersschaut, Wielsbeke, all of Belgium

[73] Assignee: N.V. Bekaert S.A., Zwevegem, Belgium

[21] Appl. No.: 783,076

[22] Filed: Jan. 15, 1997

[30] Foreign Application Priority Data

Feb. 15, 1996 [EP] European Pat. Off. ..... 96200381

[51] Int. Cl.[6] ..... B60C 9/00; D07B 1/06

[52] U.S. Cl. ..... 428/592; 428/625; 428/676; 152/451; 57/902

[58] Field of Search ..... 428/606, 607, 428/625, 676, 592; 57/902; 152/451, 565

[56] References Cited

U.S. PATENT DOCUMENTS

| | | | |
|---|---|---|---|
| 4,023,989 | 5/1977 | Dobo | 148/16 |
| 4,087,295 | 5/1978 | Sargent et al. | 148/143 |
| 4,408,444 | 10/1983 | Baillievier | 57/237 |
| 4,628,977 | 12/1986 | Ogino et al. | 152/451 |
| 4,759,806 | 7/1988 | Dambre | 428/676 |
| 4,983,227 | 1/1991 | Reiniche et al. | 148/128 |
| 5,020,312 | 6/1991 | Watakabe | 57/200 |
| 5,261,974 | 11/1993 | Hyodo et al. | 148/320 |
| 5,595,617 | 1/1997 | Tonteling et al. | 148/595 |
| 5,603,208 | 2/1997 | Fujita et al. | 57/902 |

FOREIGN PATENT DOCUMENTS

| | | |
|---|---|---|
| 0 157 045 | 10/1985 | European Pat. Off. . |
| 0 462 716 | 12/1991 | European Pat. Off. . |
| 1427999 | 3/1976 | United Kingdom . |
| 95/16816 | 6/1995 | WIPO . |

*Primary Examiner*—John J. Zimmerman
*Attorney, Agent, or Firm*—Foley & Lardner

[57] ABSTRACT

A steel cord adapted for the reinforcement of an elastomer comprises steel filaments of a pearlitic structure. The steel cord has a plastic and elastic elongation at break of x % and a plastic and elastic elongation capability in the vulcanized elastomer of y %, the values x and y fulfilling following equation:

$$y-0.50 \leq x \leq y+0.50,$$

which means that the total elongation at break does not fall down considerably after embedding the steel cord into an elastomer.

10 Claims, 2 Drawing Sheets

CORD WITH HIGH NON-STRUCTURAL ELONGATION

FIELD OF THE INVENTION

The present invention relates to a steel cord adapted for the reinforcement of an elastomer such as a rubber tire.

BACKGROUND OF THE INVENTION

Steel cords are widely known to reinforce elastomers. The reinforced elastomers form a so-called composite material. The steel cords provide for the required strength while the elastomer provides for the required elasticity. In some applications the steel cords must be able to follow as much as possible movements of the elastomer, e.g. in the outer layer of the belt of a radial tire, the so-called protection layer. In these applications a high elongation of the steel cord is strongly desired. This high elongation, i.e. an elongation at break between 5 and 10%, is achieved in the so-called high-elongation cords. The high-elongation cords are commonly multi-strand steel cords (i.e. they comprise a number of strands and each strand comprises a number of steel filaments) with a high degree of twisting (i.e. very small twisting pitches) in order to create an elastic cord with the required degree of springy potential. An example of such a cord is a 3×7×0.22 HE-cord.

These high-elongation cords, although widely used since a long time, present a number of drawbacks.

First of all, the way of manufacturing high-elongation cords is inefficient and costly due to the multi-strand character of the cords and to the high degree of twisting (i.e. the small twisting steps avoid a high output of the twisting process).

Secondly, the high-elongation cords do not enable a complete penetration by the elastomer, since any available spaces between the filaments have disappeared as a consequence of the high degree of twisting.

Thirdly, a substantial part of the elongation gets lost during the embedding of the steel cord in the elastomer. Typically, the elongation at fracture of a high-elongation cord falls down from about 7.5% to about 2.5 to 4% after the vulcanisation in rubber.

SUMMARY OF THE INVENTION

It is an object of the present invention to provide for a steel cord without substantial loss of the total elongation once it is vulcanized into the elastomer.

It is another object of the present invention to provide for a steel cord with a high elongation that is largely independent of the constructural features of the steel cord.

It is a further object of the present invention to provide for a steel cord with a high elongation and with a full penetration of the elastomer.

It is a further object of the present invention to provide for a steel cord with a high degree of processability.

According to the invention, there is provided for a steel cord adapted for the reinforcement of an elastomer. The steel cord is composed of twisted steel filaments of a pearlitic structure. The non-embedded steel cord has an elastic and plastic elongation at break which is of about the same level as the value of the elastic and plastic elongation of the steel cord once vulcanized in the elastomer.

Suppose the sum of the elastic and plastic elongation at break is x %, and the sum of elastic and plastic elongation capability in the vulcanized elastomer is y %, both values of elongation are 'of about the same level' if $$y-0.50 \leqq x \leqq y+0.50.$$

For example, if the sum of the elastic and plastic elongation x of the non-embedded steel cord is 3.5%, than the sum of the elastic and plastic elongation capability y of the steel cord in the vulcanized elastomer lies between 3.00% and 4.00%.

Preferably the values x and y fulfill following equation:

$$y-0.35 \leqq x \leqq y+0.35.$$

The terms "elastic and plastic elongation" used herein are to be understood as the total elongation minus the structural elongation.

The structural elongation, if any, is a result of the cord structure or of the preforming given to the steel filaments. Structural elongation occurs mainly below a tensile force of 50 Newton, e.g. below a tensile force of 20 Newton.

The elastic elongation follows Hooke's law ($\sigma=E\times\epsilon$) and the plastic elongation occurs mainly above 85 to 90% of the breaking force of the cord.

According to a particular embodiment of the invention the plastic elongation reaches a high value of about 4%, which be obtained by a particular mode of stress relieving the steel cord, as will be explained hereafter. This high value of plastic elongation is not a consequence of the constructional features (multiple strands, SS-direction, small twisting steps . . . ) of the cord. As a consequence, the present invention allows to obtain a high-elongation cord with an elongation that is largely independent—at least for the elastic and plastic part—of the typical type of steel cord construction. So it becomes possible to choose a high-elongation steel cord which avoids the disadvantages of the convenient high-elongation steel cords, i.e. which enables full penetration of the elastomer between the composing steel filaments and which does not require a complex and costly way of manufacturing.

Preferably the total elongation at break, i.e. the sum of the elastic, plastic and structural elongation, is at least 5%.

Preferably the steel cord as a whole is in a stress-relieved state. This stress-relieving treatment is done after the cord has been twisted to its final form.

A first advantage hereof is a high-elongation steel cord which maintains its degree of elongation in the elastomer.

A second advantage is a steel cord with a high degree of structural stability, i.e. no significant residual torsions, a high degree of straigth-ness and almost no flare. Such a cord will have no substantial processability problems during the embedding of the cord in the elastomer and can be used without problems in highly automated tire manufacturing processes. This high degree of structural stability of the cord is obtained without particular and supplemental mechanical post-treatments of the cord.

The present invention is clearly distinguished from the stress-relieving of individual steel filaments. Each steel filament that has been stress-relieved individually, also has a high plastic elongation. Twisting such stress-relieved steel filaments into a final cord means that every single filament is plastically bent and, dependent upon the particular way of twisting, that every single filament is twisted around its own axis. This leads unavoidably to a significant loss of the plastic elongation of the cord and to the creation of internal tensions in the steel filaments.

Although the total elongation of the steel cord is largely independent of the particular type of steel cord construction, the invention steel cord construction is preferably an open structure. The terms "open structure" refer to a steel cord construction which enables full penetration of the elastomer into the steel cord. This means that elastomer may surround every individual steel filament of the steel cord.

The openness may be obtained in two major ways.

A first way for obtaining an openness is to create a structure that is tangentially open. A tangentially open structure comprises layers of steel filaments that are unsaturated, which means that spaces exist between the individual steel filaments so that elastomeric material may penetrate therebetween. Unsaturated layers may be formed by appropriate choice of the number of filaments in the layer and/or by the diameter of the filaments in the layer.

A second way for obtaining an openness is to create a structure that is radially open. In a radially open structure the composing filaments are more remote from an imaginary axis than they would be in a closed compact form. The radial openness may be obtained by appropriate preforming of the steel filaments.

Obviously a radial openness may be combined with a tangential openness. An example is a 3+9-structure, where appropriate preforming of the three core filaments may result in a radial openness of the core and where the nine layer filaments may form an unsaturated layer around the core.

Preferably the steel cord has a tensile strength of at least 2150 MPa.

The yield strength of the cord at a permanent elongation of 0.2% is preferably at least 88% (e.g. at least 90% or at least 92%) of the tensile strength of the cord. This high yield strength is a direct consequence of the stress-relieving treatment that is applied on the already twisted cord and of the absence of any supplemental mechanical post-treatment.

One example of an invention steel cord may consist of two groups of steel filaments: a first group of one or more steel filaments and a second group of two or more steel filaments. If the first group has two steel filaments, these two steel filaments may be twisted or not. The second group of steel filaments is twisted around the first group so as to form an unsaturated layer around the first group, which means that spaces exist in the layer between two or more steel filaments of the second group and that elastomer may penetrate through the layer to the first group.

Such a type of steel cord construction may comprise following embodiments in a non-limitative way:

- 2+n, manufactured according to U.S. Pat. No. 4,408,444, the two filaments of the first group are not twisted and n ranges from 2 to 4;
- 1+m, one filament in the first group functioning as a core and m filaments in the second group functioning as a layer, where m ranges from 3 to 9;
- 2+m, two twisted filaments in the first group functioning as a core, and m filaments in the second group functioning as a layer where m ranges from 3 to 9;

Due to the unsaturated layer of filaments of the second group and due to the maximum number of two filaments in the first group, such a steel cord construction enables a full rubber penetration.

In addition to a substantial plastic elongation, a steel cord according to the present invention may also have a substantial structural elongation, e.g. obtained by giving the individual steel filaments an undulation by appropriate preforming or post-forming. In this way, a high-elongation 1×n-cord (n ranging from two to five) with full rubber penetration may be obtained.

BRIEF DESCRIPTION OF THE DRAWINGS

The invention will now be described into more detail with reference to the accompanying drawings wherein.

DESCRIPTION OF THE PREFERRED EMBODIMENTS OF THE INVENTION

Figure 1:
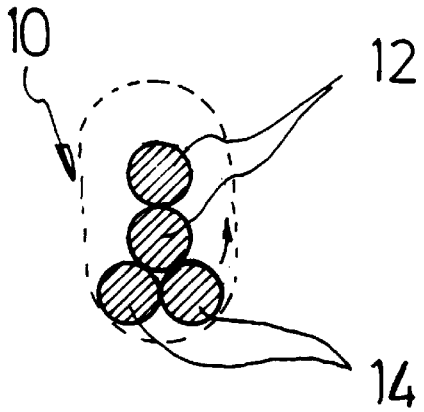
FIG. 1 shows the transversal cross-section of a first embodiment of an invention cord.

FIG. 1 shows the cross-section of a 2+2-invention cord 10. The first group comprises two non-twisted steel filaments 12, and the second group comprises two steel filaments 14 that are twisted around the first group and around each other thereby creating an unsaturated layer around the first group. Such a cord can be manufactured in one single twisting step.

Figure 2:
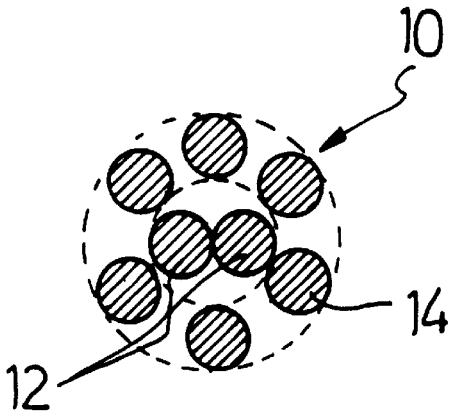
FIG. 2 shows the transversal cross-section of a second embodiment of an invention cord.

FIG. 2 shows the transversal cross-section of a 2+6-steel cord construction 10. The first group consists of two steel filaments 12 that are twisted around each other. The second group consists of six steel filaments 14 that are twisted around the first group. As can be seen on FIG. 2, the layer created by the second group is unsaturated so that rubber may penetrate. Such a steel cord may be manufactured in two steps.

Figure 3:
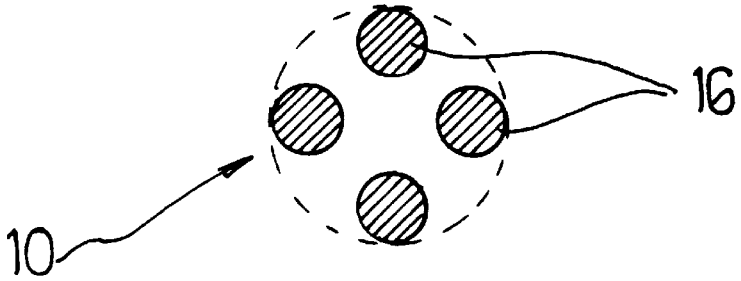
FIG. 3 shows the transversal cross-section of a third embodiment of an invention cord.

FIG. 3 shows the transversal cross-section of an alternative embodiment of a invention steel cord 10. The steel cord consists of four steel filaments 16 where one or more have been plastically formed into a wave form so that gaps have been created between the steel filaments 16 even if a tensile force is exerted on the steel cord 10. Such an open steel cord may be manufactured in one single step. The type of wave applied to individual steel filaments may vary to a great extent, depending upon the typical wave form, the amplitude and the pitch. Preferably, however, the pitch of the wave is substantially smaller than the pitch of the cord in order to create microgaps between the individual steel filaments. The wave form may be planar or spatial. A typical example is a wave form that may be obtained by passing the individual filaments between two toothed wheels, such as disclosed in U.S. Pat. No. 5,020,312. Another example is a helicoidal wave form such as disclosed in EP-A-0 462 716. Still another example is a polygonal wave form, such as mentioned in WO-A-95/16816.

Figure 4:
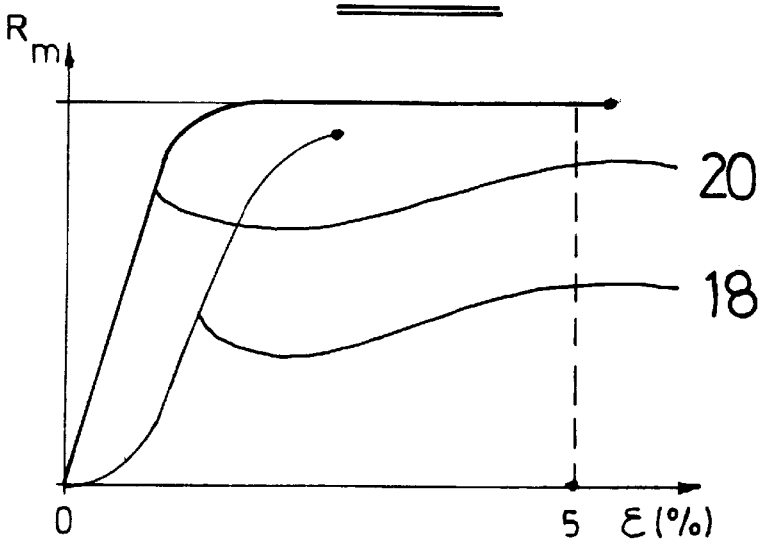
FIG. 4 compares the elongation curve of a known high-elongation cord with the elongation curve of an invention cord.

FIG. 4 shows two elongation curves 18 and 20. The abscissa is the elongation $\epsilon$, expressed in percent, and the ordinate is the tensile strength $R_m$, expressed in MPa or in $N/mm^2$.

Curve 18 is the elongation curve of a prior art high-elongation cord with a structural elongation. It shows a relatively large elongation for small initial loads (slope much smaller than the modulus E of elasticity of steel) and the total elongation at break is limited once such a cord is embedded in rubber.

Figure 5:
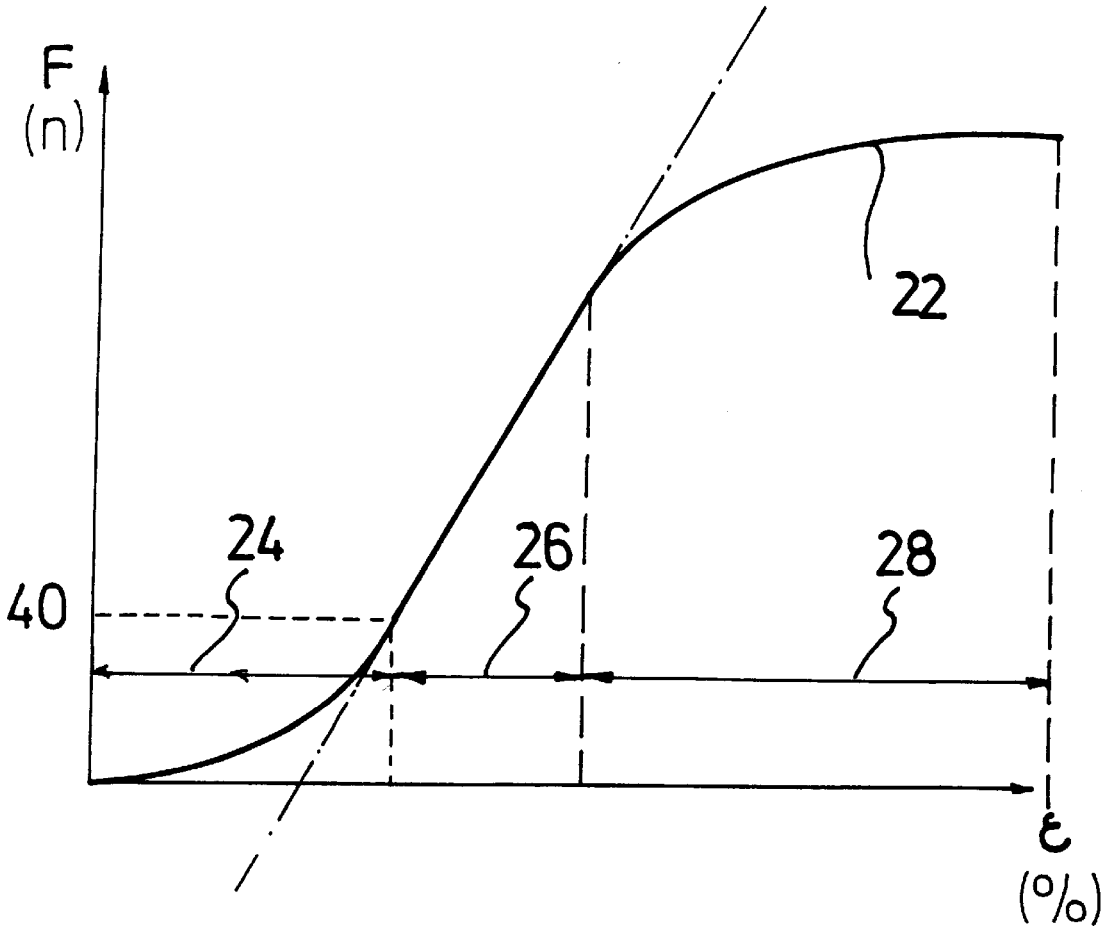
FIG. 5 shows a general elongation curve of a steel cord.

Curve 20 is the elongation curve of an invention high-elongation cord with a plastical elongation. It shows a relatively small elongation for small initial loads (slope about equal to the modulus of elasticity). The elongation at break is greater than 5% if not embedded in rubber and it remains that great after vulcanisation in rubber The differences between structural, elastic and plastic elongation are illustrated in FIG. 5 where an elongation curve 22 is shown. Three main zones can be distinguished. A first zone 24 is characterized by a relatively large initial elongation in comparison with small loads (less than 50 Newton). This initial elongation is composed of structural elongation (major part) and of elastic elongation (minor part). A second zone 26 is characterized by a linear relationship and forms the purely elastic part. A third zone 28 starts at the point where the curve leaves the linear relationship and is characterized by a non-linear saturation-like curve. The third zone is only composed of the plastic elongation. Summarizing, the structural elongation only occurs in the first zone, the elastic elongation occurs in both the first and second zone and the plastic elongation occurs in the third zone. Some steel cord constructions, however, do not have a substantial structural elongation.

EXAMPLE

A high-elongation steel cord 2×0.33+6×0.33 with twist directions S/S and twist pitches 9 mm/18 mm, according to the invention may be obtained as follows:

- the individual steel filaments receive a last intermediate patenting treatment and are subsequently coated with a layer of brass;
- thereafter, the thus coated steel filaments are wet drawn until a final diameter of 0.33 mm and a tensile strength $R_m$ of about 2900 MPa;
- the wet drawn steel filaments are twisted into the final cord 2×0.33+6×0.33, by means of a double-twisting device in a way that is known as such in the art;
- the thus twisted cord 2×0.33+6×0.33 is subjected to a stress-relieving treatment, e.g. by passing the cord through a high-frequency or mid-frequency induction coil of a length that is adapted to the speed of the cord; indeed it is observed that a thermal treatment at a specified temperature of about 300° C. and for a certain period of time brings about a reduction of tensile strength of about 10% without any increase in plastic elongation at break; by slightly increasing the temperature, however, to more than 400° C., a further decrease of the tensile strength is observed and at the same time an increase in the plastic elongation at break; in this way the plastic elongation can be increased to more than 6%, while the tensile strength decreases e.g. from 2900 MPa to about 2500 MPa for this particular diameter of 0.33 mm.

The brass coated steel filaments or steel cords, although this is not strictly necessary, may be subjected to an acid dip in order to avoid or to take away any zinc oxide layer that can be created on the brass during the stress-relieving treatment.

A first table summarizes some of the particular properties of a 2×0.33+6×0.33 invention steel cord and compares these properties to the corresponding properties of a convenient 3×7×0.22 HE-cord:

TABLE 1

| Properties and features: | 2 × 0.33 + 6 × 0.33 | 3 × 7 × 0.22 HE |
|---|---|---|
| direction of twist | S S | S S |
| lay length (mm) | 9/18 | 4.5/8 |
| linear density (g/m) | 5.30 | 6.95 |
| optical diameter (mm) | 1.185 | 1.585 |
| part load elongation at initial load of 50 Newton (%) | 0.078 | 2.82 |

TABLE 1-continued

| Properties and features: | 2 × 0.33 + 6 × 0.33 | 3 × 7 × 0.22 HE |
|---|---|---|
| tensile test on cord not embedded in rubber: | | |
| breaking load (Newton) | 1652 | 1820 |
| tensile strength $R_m$ (MPa): | 2448 | 2280 |
| total elongation at break (%) | 5.64 | 6.00 |
| yield strength at elongation of 0.2% (% of $R_m$) | 91 | 82* |
| tensile test on cord embedded in rubber: | | |
| breaking load (Newton) | 1705 | 1925 |
| tensile strength $R_m$ (MPa) | 2527 | 2412 |
| total elongation at break (%) | 5.51 | 3.20 |
| yield strength at elongation of 0.2% (% of $R_m$) | 90 | 83* |
| arc height (mm) | 6 | 14 |
| 3-point bending stiffness ($Nmm^2$) of non-embedded cord | 1010 | |
| 3-point bending stiffness ($Nmm^2$) of embedded cord | 1394 | |
| Hunter fatigue test | | |
| dry not embedded in rubber (MPa) | 900 | 1000 |
| dry embedded in rubber (MPa) | 900 | 1000 |
| wet embedded in rubber (MPa) | 800 | 450 |

*yield strength has been determined on the elastic part of the tensile-elongation curve, so leaving away the structural part As may be derived from table 1, the total elongation at break does not decrease significantly after embedding the invention cord in rubber. This is a direct consequence of the thermal stress-relieving treatment which has been applied on the final twisted cord. This thermal treatment occurred at a higher temperature than the temperature of rubber vulcanisation, so that the vulcanisation process 'was no longer able' to change the properties of the invention cord significantly.

A further advantage of the invention cord is that the fatigue resistance does not decrease significantly in wet circumstances, whereas the convenient high elongation cord sees its fatigue resistance fall to less than 50%. This is a consequence of the rubber penetration which is complete in the invention cord and incomplete in the prior art cord.

A second table compares a 1+5 invention cord to a 1+5 cord where the particular stress-relieving treatment has not been applied.

TABLE 2

| Properties and features: | 1 × 0.38 + 5 × 0.38 stress-relieved | 1 × 0.38 + 5 × 0.38 prior art |
|---|---|---|
| direction of twist | S | S |
| lay length (mm) | 20 | 20 |
| linear density (g/m) | 5.35 | 5.35 |
| optical diameter (mm) | 1.16 | 1.16 |
| part load elongation at initial load of 50 Newton (%) | 0.070 | 0.061 |
| tensile test on cord not embedded in rubber: | | |
| breaking load (Newton) | 1703 | 1618 |
| tensile strength $R_m$ (MPa): | 2497 | 2382 |

TABLE 2-continued

| Properties and features: | 1 × 0.38 + 5 × 0.38 stress-relieved | 1 × 0.38 + 5 × 0.38 prior art |
|---|---|---|
| total elongation at break (%) | 6.69 | 3.25 |
| yield strength at elongation of 0.2% (% of $R_m$) | 90 | 84 |
| tensile test on cord embedded in rubber: | | |
| breaking load (Newton) | 1755 | 1795 |
| tensile strength $R_m$ (MPa) | 2574 | 2645 |
| total elongation at break (%) | 6.67 | 1.72 |
| yield strength at elongation of 0.2% (% of $R_m$) | 90 | 84 |
| arc height (mm) | 4 | 6 |
| 3-point bending stiffness ($Nmm^2$) of embedded cord | 1724 | |
| Hunter fatigue test | | |
| dry not embedded in rubber (MPa) | 1000 | 950 |
| dry embedded in rubber (MPa) | 950 | 950 |
| wet embedded in rubber (MPa) | 850 | 950 |

The total elongation at break of a 1+5 prior art cord is only 3.25% and falls down to a poor 1.72% after embedding the steel cord in rubber. The invention 1+5 cord, in contrast therewith, has a high elongation of 6.69% and maintains this high level after embedding the steel cord in rubber.

With steel filaments of a martensitic structure instead of steel filaments of a pearlitic structure, the inventors have experienced that a total elongation at break of at least 5% is difficult to reach, and that, even if a high elongation at break is reached for a non-embedded steel cord, this elongation falls down considerably once the cord has been vulcanized in an elastomer.

In addition to the above-mentioned characteristics and properties, a steel cord according to the present invention has following features which make it able for the reinforcement of elastomers such as rubber:

- the filament diameters range from 0.04 mm to 1.1 mm, more specifically from 0.15 mm to 0.60 mm, e.g. from 0.20 mm to 0.45 mm;
- the steel composition generally comprises a minimum carbon content of 0.60% (e.g. at least 0.80%, with a maximum of 1.1%), a manganese content ranging from 0.20 to 0.90% and a silicon content ranging from 0.10 to 0.90%; the sulphur and phosphorous contents are preferably kept below 0.03%; additional elements such as chromium (up to 0.2 à 0.4%), boron, cobalt, nickel, vanadium . . . may be added to the composition;
- the filaments are conveniently covered with a corrosion resistant coating such as zinc or with a coating that promotes the adhesion to the rubber such as brass, or a so-called ternary brass such as copper-zinc-nickel (e.g. 64%/35.5%/0.5%) and copper-zinc-cobalt (e.g. 64%/35.7%/0.3%), or a copper-free adhesion layer such as zinc-cobalt or zinc-nickel; the conventional brass layer may also be provided with a top flash of nickel, cobalt or copper; these top flashes, which are known as such, can be very advantageous in the context of the present invention since they prevent the zinc in the brass from migrating to the surface and from building zinc oxide during the stress-relieving treatment; in the case of a nickel top layer, suitable amounts of nickel have proved to range from 1 to 4% weight per cent of the coating layer, below 1% the effect of nickel is not pronounced, above 4% the level of initial adhesion decreases.

The invention is suitable for all common and available final tensile strengths from 2150 MPa to about 3500 MPa and more. Due account must, however, been taken of a drop in tensile strength of about 10 to 15% as a consequence of the thermal stress-relieving treatment. If for example, a final tensile strength of 3500 MPa is desired, the individual steel filaments must be drawn to a tensile strength of about 4000 MPa, if a final tensile strength of 2150 MPa is desired, the individual steel filaments must be drawn to a tensile strength of about 2400 MPa.

We claim:

1. A steel cord adapted for the reinforcement of a vulcanized elastomer, the steel cord comprising steel filaments of a pearlitic structure and having a coating of brass, the steel cord having been subjected to a stress-relieving treatment at such a temperature that (a) the steel cord has a total elongation at break exceeding 5%; and that (b) the steel cord has a plastic and elastic elongation at break of x% and an elastic and plastic elongation capability in the vulcanized elastomer of y%, the values of x and y fulfilling:

$$y-0.50 \leqq x \leqq y+0.50.$$

2. A steel cord according to claim 1 wherein the steel cord has a final tensile strength of at least 2150 MPa.

3. A steel cord according to claim 1 wherein the steel cord has a yield strength at a permanent elongation of 0.2% that is at least 88% of the tensile strength of the steel cord.

4. A steel cord according to claim 1 wherein the steel cord has an open structure to enable rubber penetration of the elastomer.

5. A steel cord according to claim 4 wherein one or more of the steel filaments form a first group and the other steel filaments form a second group of two or more filaments, the second group being twisted around the first group so as to form an unsaturated layer around the first group.

6. A steel cord according to claim 5 wherein the second group consists of three to nine steel filaments.

7. A steel cord according to claim 5 wherein the first group consists of one or two steel filaments.

8. A steel cord according to claim 1 wherein the steel cord has a structural elongation of at least 0.5%.

9. A steel cord according to claim 1 wherein the filaments have a diameter ranging from 0.04 mm to 1.10 mm.

10. A steel cord according to claim 1 wherein the steel filaments have a top flash of nickel, cobalt or copper on top of the brass coating.

* * * * *